United States Patent [19]

Bigelow

[11] 4,210,716

[45] Jul. 1, 1980

[54] SILVER HALIDE EMULSION CONTAINING TETRATHIOCINO DIISOTHIAZOLES AS ANTIFOGGERS

[75] Inventor: John H. Bigelow, St. Petersburg, Fla.

[73] Assignee: E. I. Du Pont de Nemours and Company, Wilmington, Del.

[21] Appl. No.: 8,049

[22] Filed: Jan. 31, 1979

[51] Int. Cl.[2] ..... G03C 1/34

[52] U.S. Cl. ..... 430/615; 430/448; 430/600

[58] Field of Search ..... 96/107, 109, 66.5

[56] References Cited

U.S. PATENT DOCUMENTS

| | | | |
|---|---|---|---|
| 3,656,955 | 4/1972 | Ushimaru et al. | 96/107 |
| 3,857,711 | 12/1974 | Ohi et al. | 96/107 |
| 3,859,100 | 1/1975 | Kondo et al. | 96/109 |
| 3,926,632 | 12/1975 | Hofman et al. | 96/109 |
| 4,054,457 | 10/1977 | Bigelow | 96/107 |
| 4,066,656 | 1/1978 | Vladuchick | 260/302 F |

*Primary Examiner*—J. Travis Brown

[57] ABSTRACT

Compounds of the general formula:

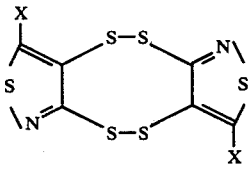

wherein X is cyano or

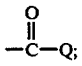

Q is $OR_1$ or $—NR_2R_3$; $R_1$ is hydrogen or alkyl of 1–4 carbon atoms, $R_2$ is hydrogen or methyl, and $R_3$ is hydrogen or alkyl of 1–4 carbon atoms, are incorporated into light sensitive silver halide emulsions to improve their sensitometric characteristics.

14 Claims, No Drawings

SILVER HALIDE EMULSION CONTAINING TETRATHIOCINO DIISOTHIAZOLES AS ANTIFOGGERS

FIELD OF INVENTION

This invention is directed to photographic materials comprising light-sensitive silver halide emulsions and, in particular, to stabilized silver halide emulsions containing an effective antifoggant.

BACKGROUND OF THE INVENTION

Gelatino-silver halide emulsions are subject to fogging, which may be defined as a uniform deposit of silver extending over, and either partially or wholly obliterating, the image. Fog may be caused in a number of ways, as for example, by excessive ripening of the emulsion, by storage of the light-sensitive element at elevated temperatures and humidity, or by prolonged development of the exposed emulsion.

A great number of antifogging and stabilizing agents have been recommended in the literature for the purpose of preventing the formation of fog in light-sensitive silver halide emulsions. Although these compounds have the ability to control fog during manufacture, as well as during storage, many of these compounds adversely affect other sensitometric properties such as speed, gradient and Dmax. It is, accordingly, an object of this invention to provide a light-sensitive emulsion which has a reduced tendency to fog; but at the same time retains a good balance of other sensitometric properties.

SUMMARY OF THE INVENTION

A tetrathiocino diisothiazole of the formula

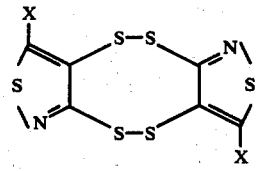

wherein X is cyano or

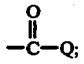

Q is $—OR_1$ or $—NR_2R_3$; $R_1$ and $R_3$ are hydrogen or alkyl of 1–4 carbon atoms, and $R_2$ is hydrogen or methyl, is incorporated into a photographic element comprising a light-sensitive silver halide emulsion layer on a support. It is preferred to add these compounds to the silver halide emulsion, but it is also possible to incorporate them into an auxiliary layer which may or may not be contiguous to the emulsion layer. These compounds act as antifoggants by restraining fog growth; but at the same time, act as development accelerators by increasing gradient and Dmax, usually at some speed loss.

DETAILED DESCRIPTION OF THE INVENTION

The tetrathiocino diisothiazoles may be added to silver halide emulsions during the digestion stage of preparation of said emulsions or as a final addition just prior to coating the silver halide emulsion onto a support. There is some indication that the presence of these compounds during digestion allows greater fog reduction than addition as a final just prior to coating, which suggests that these compounds may be interfering with the formation of fog centers, as well as covering up centers already formed, or preventing development of fog centers. It is believed that the tetrathiocino portion of the molecule may be a more important part for antifogging than the isothiazole. These compounds may also be used in combination with other known antifoggants, which are usually added as final additions just prior to coating the silver halide emulsions onto a support. In general, these compounds are added to a silver halide emulsion after it has been chemically sensitized with a conventional gold, sulfur and/or reduction sensitizer.

Among the tetrathiocino diisothiazole compounds suitable for this invention the following are illustrative:

Compound 1

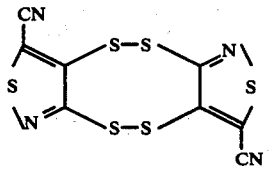

[1,2,5,6] tetrathiocino [3,4-c; 7,8-c'] diisothiazole-3,8-dicarbonitrile

Compound 2

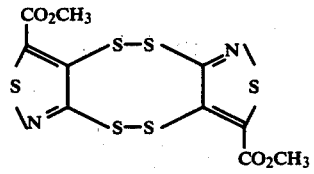

[1,2,5,6] tetrathiocino [3,4-c; 7,8-c'] diisothiazole-3,8-dicarboxylic acid dimethyl ester Compound 3

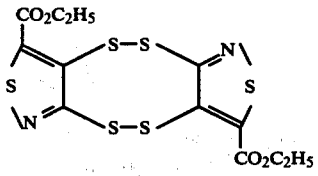

[1,2,5,6] tetrathiocino [3,4-c; 7,8-c'] diisothiazole-3,8-dicarboxylic acid diethyl ester Compound 4

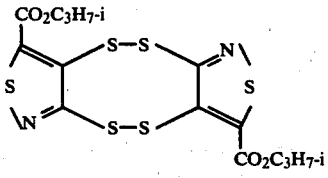

[1,2,5,6] tetrathiocino [3,4-c; 7,8-c'] diisothiazole-3,8-dicarboxylic acid diisopropyl ester Compound 5

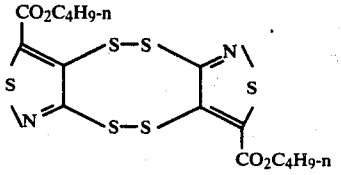

[1,2,5,6] tetrathiocino [3,4-c; 7,8-c'] diisothiazole-3,8-dicarboxylic acid di n-butyl ester Compound 6

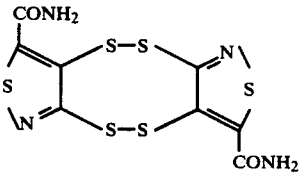

[1,2,5,6] tetrathiocino [3,4-c; 7,8-c'] diisothiazole-3,8-dicarboxamide

Compound 7

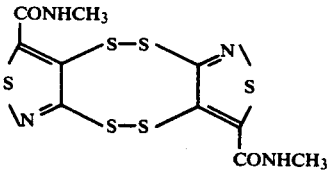

[1,2,5,6] tetrathiocino [3,4-c; 7,8-c'] diisothiazole-3,8-dicarboxamide, N,N'-dimethyl Compound 8

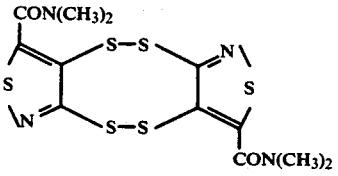

[1,2,5,6] tetrathiocino [3,4-c; 7,8-c'] diisothiazole-3,8-dicarboxamide, N,N,N', N'-tetramethyl Compound 9

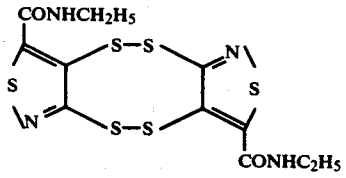

[1,2,5,6] tetrathiocino [3,4-c; 7,8-c'] diisothiazole-3,8-dicarboxamide, N,N'-diethyl Compound 10

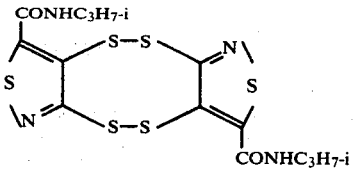

[1,2,5,6] tetrathiocino [3,4-c; 7,8-c'] diisothiazole-3,8-dicarboxamide, N,N'-diisopropyl Compound 11

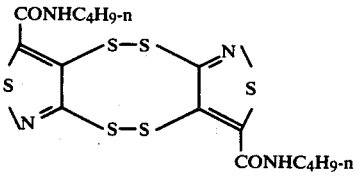

[1,2,5,6] tetrathiocino [3,4-c; 7,8-c'] diisothiazole-3,8-dicarboxamide, N,N'-di-n-butyl These compounds may be incorporated into any type of light-sensitive silver halide emulsion layer, e.g., a spectrally sensitized or nonsensitized silver halide layer, a radiographic emulsion layer, and a high speed negative or positive light-sensitive emulsion. Of course, the amount to be added will vary dependent on the particular type of emulsion and can vary within wide limits. Enough compound is added to the emulsion to give good antifoggant properties without significant change in other photographic properties like speed, gradient or Dmax. Optimum amounts to be added can be determined for each emulsion by simple experiment as is customary in the art of emulsion manufacture. Generally, the most suitable concentration will be between $1.6\times10^{-6}$ mole to $1.7\times10^{-4}$ mole per 1.5 moles of silver halide in the emulsion. However, greater or lesser amounts can be used.

[1,2,5,6] tetrathiocino [3,4-c; 7,8-c'] diisothiazole-3,8-dicarbonitrile was prepared by the procedure described in Vladuchick, U.S. Pat. No. 4,066,656 "[1,2,5,6]Tetrathiocino-[3,4-C; 7,8-C']Diisothiazole-3,8-Dicarbonitrile". The dicarboxylic acid was prepared from the dicarbonitrile by base hydrolysis while the amides and esters were prepared via reaction with the acid chloride by standard manipulation.

The silver halide constituent of the light-sensitive silver halide emulsion may be any of the usual types such as silver chloride, silver bromide, silver iodide or solid solutions thereof, in the form of single salt or mixed silver halide grains or crystals e.g. silver chromobromide, silver iodobromide, etc. These can be doped with other metal cations such as divalent lead or tin. These silver halide emulsion grains may be chemically sensitized with noble metal salts and labile sulfur compounds, e.g., gold chloride and sodium thiosulfate, as commonly practiced in the art of emulsion manufacture. Other addenda such as hardeners, wetting agents and plasticizers may be added in the usual manner.

Gelatin is the preferred binder for the silver halide grains, but it may be partially replaced with other material or synthetic binders as known in the art. Thus, binders used to increase covering power, e.g., dextran, dextrin, polyvinyl pyrrolidone, etc., as well as latices of polymers such as poly (ethyl acrylate) which are useful in improving dimensional stability and other physical properties are advantageously included in silver halide emulsions used in this invention.

The silver halide elements of this invention may include one or a plurality of emulsion layers, and may be coated on a support such as glass, paper or polymeric film (e.g., a polyester film).

Silver halide emulsions were prepared according to the following procedures.

Procedure A: Silver Iodobromide Emulsion

A gelatino-silver iodobromide emulsion containing 1.27% iodide was made by adding aqueous silver nitrate solution in two equal portions to an aqueous gelatin solution containing the required amount of potassium iodide and bromide. The precipitation was carried out at 114.5° F. (45.8° C.). After the first silver nitrate addition, the emulsion was ripened 12 minutes; and after the second addition, it was ripened for 6 minutes in the presence of sufficient ammonia to convert 13% of the silver present and the ammonia was then neutralized with sulfuric acid. The emulsion was then cooled, coagulated, washed and redispersed in a conventional manner.

Procedure B: Monodisperse Silver Iodobromide Emulsion

A gelatino-silver iodobromide emulsion containing 1.5 mole % iodide was made by a balanced double-jet method in which both soluble silver nitrate and alkali metal iodobromide salts were added to an aqueous ammoniacal gelatin solution at a temperature of 115° F. (46.1° C.) and at a constant pAg of 8.35 to produce cubic silver iodobromide grains having a mean grain volume of 0.031 cubic microns and a narrow grain size distribution. The emulsion was freed from soluble salts by lowering the pH to 2, cooling the emulsion to 85° C., coagulating with 500 ml of a solution of a water-soluble o-sulfobenzaldehyde partial acetal of polyvinyl alcohol, and washing.

Procedure C: Negative Type Emulsion Digestion

To an emulsion containing silver halide equivalent to 1.5 moles of silver nitrate and prepared by Procedure A above there was added bulking gelatin and the temperature was raised to 110° F. The pH was adjusted, the emulsion was heated to 125° F. (51.7° C.) and there was added $1.6\times10^{-5}$ mole of a conventional sulfur sensitizer (sodium thiosulfate), $5.28\times10^{-6}$ mole of gold in the form of $HAuCl_4$ and $3.81\times10^{-3}$ mole of KSCN, a gold complexing compound.

The emulsion was then digested for 120 minutes at 125° F. (51.7° C.), and was then optically sensitized. The pH was then adjusted to 5.5, and a coating aid was added, along with formaldehyde as the gelatin hardener. The compounds of this invention were now added to the emulsion. The latter was then coated upon a photographic quality poyethylene terephthalate film base and dried in conventional manner. Said film base had been first coated on both sides with a vinylidene chloride-alkyl acrylate/itaconic acid copolymer mixed with an alkyl acrylate. Over this there had been coated on both sides a thin anchoring substratum of gelatin (0.5 mg/dm$^2$).

Procedure D: Negative Type Emulsion Digestion

To an emulsion containing the silver halide equivalent of 1.5 moles silver nitrate, and prepared by Procedure B above, there was added bulking gelatin and the temperature raised to 110° F. (43.3° C.). The pH was adjusted to 6.3, the emulsion heated to 130° F. (54.5° C.), and there was added $4.6\times10^{-6}$ mole of gold in the form of $AuCl_3$, $3.2\times10^{-5}$ mole of sodium thiosulfate, and $1.4\times10^{-3}$ mole of KSCN. The emulsion was digested for 35 minutes at 130° F. (54.5° C.). After digestion, a coating aid and a gelatin hardener were added to the emulsion, the emulsion was cooled to 95° F. (35° C.) and the pAg was adjusted to 9.1. The tetrathiocino diisothiazole compounds were now added to the emulsion. This was then coated on a polyester support, similar to that described in Procedure C, to provide a coating of 75 mg of silver halide per dm$^2$, and dried in a conventional manner.

Coated and dried samples were tested, fresh (F) and after being oven aged (0) for 7 days at 120° F. and 65% relative humidity, using the methods described below:

Method 1

A coated and dried sample was exposed for $10^{-4}$ seconds in a sensitometer, through a $\sqrt{2}$ step wedge, by means of a lamp which provided an exposure of 130 meter-candle-seconds, developed for 60 seconds at 80° F. (26.7° C.) in a conventional hydroquinone-phenidone type developer, fixed, washed and dried. 1X/3X fog samples were processed for 1 minute and 3 minutes as above with no exposure.

Method 2

A coated and dried sample was exposed for $10^{-2}$ seconds in a EG&G. Mark VI Xenon Sensitometer through a 1.6 neutral density filter, and developed in a hydroquinone/phenidone type developer, fixed, washed and dried.

Method 3

Method 1 was repeated but with a K-2 filter to measure response to exposure in the green.

EXAMPLE 1

Gelatino-silver iodobromide emulsions were prepared as described in Procedure A, digested and coated as in Procedure C with the pH adjusted to 5.61, and tested as described in Methods 1 and 3. Varying amounts of Compound 1, indicated in Table 1, were also added to the emulsions as final additions just prior to coating. Results are shown in the following table.

Table 1

| | | | Method #1 | | | Method #3 | | | Amt. in Moles of Compound 1 Per 1.5 |
|---|---|---|---|---|---|---|---|---|---|
| Ctg. # | Test Age | 1X/3X Fog | Fog | D-Max | Relative Speed | Fog | D-Max | Relative Speed | Moles of Silver Halide |
| 1 | F | 04/09 | .04 | 3.02 | 190 | .05 | 2.62 | 174 | None |

Table 1-continued

| Ctg. # | Test Age | 1X/3X Fog | Method #1 Fog | Method #1 D-Max | Method #1 Relative Speed | Method #3 Fog | Method #3 D-Max | Method #3 Relative Speed | Amt. in Moles of Compound 1 Per 1.5 Moles of Silver Halide |
|---|---|---|---|---|---|---|---|---|---|
| | 0 | 06/15 | .05 | 2.76 | 155 | .05 | 2.29 | 111 | |
| 2 | F | 03/05 | .03 | 3.11 | 173 | .03 | 2.79 | 167 | $1.6 \times 10^{-6}$ |
| | 0 | 03/07 | .04 | 2.87 | 174 | .04 | 2.45 | 120 | |
| 3 | F | 01/02 | .01 | 3.05 | 175 | .01 | 2.62 | 169 | $8.5 \times 10^{-6}$ |
| | 0 | 01/02 | .01 | 2.83 | 167 | .02 | 2.41 | 105 | |
| 4 | F | 00/01 | .00 | 3.07 | 164 | .01 | 2.85 | 165 | $1.7 \times 10^{-5}$ |
| | 0 | 00/01 | .01 | 2.87 | 155 | .01 | 2.44 | 105 | |
| 5 | F | 00/00 | .00 | 3.03 | 150 | .00 | 2.63 | 131 | $3.4 \times 10^{-5}$ |
| | 0 | 00/01 | .00 | 2.77 | 154 | .00 | 2.35 | 94 | |
| 6 | F | 00/00 | .00 | 2.81 | 137 | .00 | 2.63 | 112 | $1.7 \times 10^{-4}$ |
| | 0 | 00/01 | .00 | 2.77 | 138 | .00 | 2.25 | 88 | |
| 7 | NA | 03/04 | .04 | 2.50 | 100 | .03 | 2.26 | 100 | None |

EXAMPLE 2

Gelatino-silver iodobromide emulsions were prepared as described in Example 1, with the following variations: $1.6 \times 10^{-6}$ mole of tert.-butyl diphenyl methyl trithiocarbonate was added and the pH adjusted to 5.52 before digestion. Compound 1 was added, as a final addition just prior to coating, in amounts indicated in Table II. Results are shown in the following Table.

Table II

| Ctg. # | Test Age | 1X/3X Fog | Fog | D-Max | Speed | Fog | D-Max | Relative Speed | Moles of Compound 1/1.5 Moles of Silver Halide |
|---|---|---|---|---|---|---|---|---|---|
| 1 | F | 06/12 | .07 | 3.20 | 183 | .07 | 2.62 | 166 | None (Control) |
| | 0 | 08/22 | .11 | 2.88 | 146 | .09 | 2.39 | 105 | |
| 2 | F | 03/05 | .03 | 3.13 | 177 | .03 | 2.79 | 146 | $1.6 \times 10^{-6}$ |
| | 0 | 03/06 | .05 | 3.03 | 158 | .04 | 2.52 | 102 | |
| 3 | F | 01/03 | .02 | 3.16 | 173 | .01 | 2.62 | 131 | $8.5 \times 10^{-6}$ |
| | 0 | 01/03 | .01 | 2.96 | 139 | .02 | 2.56 | 93 | |
| 4 | F | 00/01 | .00 | 3.18 | 139 | .00 | 2.85 | 122 | $1.7 \times 10^{-5}$ |
| | 0 | 00/02 | .01 | 3.11 | 167 | .00 | 2.52 | 91 | |
| 5 | F | 00/00 | .00 | 3.13 | 140 | .00 | 2.63 | 109 | $3.4 \times 10^{-5}$ |
| | 0 | 00/00 | .00 | 3.02 | 152 | .00 | 2.40 | 92 | |
| 6 | F | 00/00 | .00 | 3.15 | 131 | .00 | 2.63 | 98 | $1.7 \times 10^{-4}$ |
| | 0 | 00/00 | .00 | 3.02 | 144 | .00 | 2.48 | 89 | |
| 7 | NA | 03/04 | .04 | 2.50 | 100 | .03 | 2.26 | 100 | None |

EXAMPLE 3

Example 1 was repeated with the variations in digestion pH and antifogger addition indicated in Table III. Compound 1 gives reduced fog with little reduction in speed for both the fresh and oven aged samples.

Table III

| Ctg. # | Test Age | 1X/3X Fog | Fog | D-Max | Relative Speed | Fog | D-Max | Relative Speed | Dig. pH | Moles of Compound 1/1.5 Moles of Silver Halide |
|---|---|---|---|---|---|---|---|---|---|---|
| 1 | F | 02/06 | .03 | 3.17 | 170 | .03 | 2.76 | 182 | 5.3 | None |
| | 0 | 04/08 | .06 | 3.22 | 187 | .05 | 2.72 | 171 | | |
| 2 | F | 00/01 | .01 | 2.93 | 160 | .00 | 2.50 | 135 | " | $1.7 \times 10^{-5}$ |
| | 0 | 00/01 | .01 | 3.00 | 159 | .00 | 2.68 | 139 | | |
| 3 | F | 00/02 | .03 | 3.04 | 160 | .02 | 2.52 | 159 | 5.5 | None |
| | 0 | 04/08 | .05 | 2.88 | 152 | .05 | 2.35 | 141 | | |
| 4 | F | 00/00 | .00 | 3.25 | 152 | .00 | 2.59 | 136 | 5.5 | $1.7 \times 10^{-5}$ |
| | 0 | 00/01 | .00 | 3.25 | 156 | .00 | 2.76 | 127 | | |
| 5 | F | 00/05 | .04 | 3.56 | 186 | .03 | 3.19 | 189 | 5.7 | None |
| | 0 | 06/15 | .07 | 3.25 | 184 | .07 | 3.04 | 188 | | |
| 6 | F | 00/00 | .01 | 3.38 | 172 | .01 | 2.60 | 147 | " | $1.7 \times 10^{-5}$ |
| | 0 | 01/03 | .02 | 3.37 | 175 | .01 | 3.01 | 160 | | |

EXAMPLE 4

Example 1 was repeated with the variations in antifogger addition indicated in Table IV. The emulsions were digested at a pH of 5.5. Results are shown in the following table.

Table IV

| Ctg. # | Test Age | 1X/3X Fog | Fog | D-Max | Relative Speed | Moles of Antifogger/1.5 Moles of Silver Halide: 4 hydroxy-6-methyl-1,3,3a,7 tetra-azain-dene | Moles of Antifogger/1.5 Moles of Silver Halide: Compound 1 |
|---|---|---|---|---|---|---|---|
| 1 | F | 18/28 | .18 | 2.66 | 133 | None | None (Control) |
| 2 | F | 17/27 | .12 | 2.53 | 126 | $4.6 \times 10^{-2}$ | None (control) |
| 3 | F | 03/08 | .03 | 2.56 | 106 | $4.6 \times 10^{-2}$ | $1 \times 10^{-5}$ |
| 4 | F | 00/02 | .00 | 2.43 | 33 | $4.6 \times 10^{-2}$ | $1 \times 10^{-4}$ |
| 5 | F | 04/10 | .02 | 2.85 | 105 | None | $1 \times 10^{-5}$ |
| 6 | F | 00/02 | .00 | 3.05 | 60 | None | $1 \times 10^{-4}$ |

The results show that the tetraazaindene compound is not needed for good antifogging when the compounds of the invention are used.

EXAMPLE 5

Example 1 was repeated with variations in the antifogger addition indicated in Table V.

Table V

| Ctg. # | 1X/3X Dev. Fog | Fog | D-Max | Speed | Moles of Compd. 1/1.5 Moles of Silver Halide |
|---|---|---|---|---|---|
| 1 | 20/44 | .18 | 2.92 | 126 | Control - None |
| 2 | 12/33 | .12 | 3.12 | 131 | $1.7 \times 10^{-5}$ as a final |
| 3 | 08/22 | .07 | 3.02 | 126 | $1.7 \times 10^{-5}$ at digest |

The control shows high fog. Fog is reduced when Compound 1 is added as a final addition just prior to coating, and further reduced when the antifogger is added during digestion.

EXAMPLE 6

Silver iodobromide emulsions were prepared as described in Procedure B and digested as in Procedure D. Compound 8 was added to the emulsion, as a final addition just prior to coating, in amounts indicated in Table VI.

Table VI

| Ctg. # | Grams Compd. 8 Per 1.5 Moles Silver Halide | Relative Speed | Fog | Grad. | Development Time (Seconds) |
|---|---|---|---|---|---|
| | None | 100 | 0.21 | 2.7 | 30 |
| 2 | None | 140 | 0.25 | 2.9 | 60 |
| 3 | 0.075 | 95 | 0.11 | 3.2 | 30 |
| 4 | 0.075 | 120 | 0.12 | 3.4 | 60 |

I claim:

1. A photographic element comprising a light-sensitive silver halide emulsion, a support therefor, and an antifoggant amount of a tetrathiocino diisothiazole of the formula

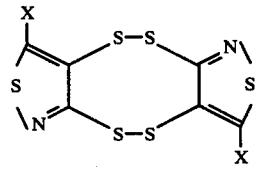

wherein X is cyano or

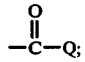

Q is —$OR_1$ or —$NR_2R_3$; $R_1$ and $R_3$ are hydrogen or alkyl of 1–4 carbon atoms and $R_2$ is hydrogen or methyl.

2. The photographic element of claim 1 wherein the tetrathiocino diisothiazole is located in the silver halide emulsion.

3. The photographic element of claim 1 wherein the tetrathiocino diisothiazole is located in a layer adjacent the silver halide emulsion.

4. The photographic element of claim 1 wherein said tetrathiocino diisothiazole is [1,2,5,6,] tetrathiocino [3,4-c; 7,8-c'] diisothiazole-3,8-dicarbonitrile.

5. The photographic element of claim 1 wherein said tetrathiocino diisothiazole is [1,2,5,6] tetrathiocino [3,4-c; 7,8-c'] diisothiazole-3,8-dicarboxylic acid dimethyl ester.

6. The photographic element of claim 1 wherein said tetrathiocino diisothiazole is [1,2,5,6] tetrathiocino [3,4-c; 7,8-c'] diisothiazole-3,8-dicarboxylic acid diethyl ester.

7. The photographic element of claim 1 wherein said tetrathiocino diisothiazole is [1,2,5,6] tetrathiocino [3,4-c; 7,8-c'] diisothiazole-3,8-dicarboxylic acid diisopropyl ester.

8. The photographic element of claim 1 wherein said tetrathiocino diisothiazole is [1,2,5,6] tetrathiocino [3,4-c; 7,8-c'] diisothiazole-3,8-dicarboxylic acid di-n-butyl ester.

9. The photographic element of claim 1 wherein said tetrathiocino diisothiazole is [1,2,5,6] tetrathiocino [3,4-c; 7,8-c'] diisothiazole-3,8-dicarboxamide.

10. The photographic element of claim 1 wherein said tetrathiocino diisothiazole is [1,2,5,6] tetrathiocino [3,4-c; 7,8-c'] diisothiazole-3,8-dicarboxamide, N,N'-dimethyl.

11. The photographic element of claim 1 wherein said tetrathiocino diisothiazole is [1,2,5,6] tetrathiocino [3,4-c; 7,8-c'] diisothiazole-3,8-dicarboxamide, N,N,N',N'-tetramethyl.

12. The photographic element of claim 1 wherein said tetrathiocino diisothiazole is [1,2,5,6] tetrathiocino [3,4-c; 7,8-c'] diisothiazole-3,8-dicarboxamide, N,N'-diethyl.

13. The photographic element of claim 1 wherein said tetrathiocino diisothiazole is [1,2,5,6] tetrathiocino [3,4-c; 7,8-c'] diisothiazole-3,8-dicarboxamide, N,N'-diisopropyl.

14. The photographic element of claim 1 wherein said tetrathiocino diisothiazole is [1,2,5,6] tetrathiocino [3,4-c; 7,8-c'] diisothiazole-3,8-dicarboxamide, N,N'-di-n-butyl.

* * * * *